United States Patent [19]

Benoit et al.

[11] Patent Number: 4,790,081

[45] Date of Patent: Dec. 13, 1988

[54] MANIPULATION LEVER FOR CLOSING AND LATCHING OF A REAR-ENTRY SKI BOOT

[75] Inventors: Louis Benoit, Frangy; Bernard Nerrinck, La Balme-De-Sillingy; Joseph Morell, Annecy; Roland Petrini, Chambery, all of France

[73] Assignee: Salomon S.A., Annecy, France

[21] Appl. No.: 51,765

[22] Filed: May 20, 1987

Related U.S. Application Data

[62] Division of Ser. No. 700,302, Feb. 11, 1985, Pat. No. 4,698,920.

[30] Foreign Application Priority Data

Feb. 11, 1984 [FR] France ..... 84 02900
May 18, 1984 [FR] France ..... 84 08598

[51] Int. Cl.[4] ..... A43C 11/00; A43B 5/04

[52] U.S. Cl. ..... 36/50; 36/117; 36/119; 24/68 SK

[58] Field of Search ..... 36/117-121, 36/50, 105, 115; 24/68 SK, 69 SK, 70 SK, 71 SK

[56] References Cited

U.S. PATENT DOCUMENTS 4,083,130 4/1978 Bertetto et al. ..... 36/117
4,408,403 10/1983 Martin ..... 36/117
4,539,763 9/1985 Walkhoff ..... 36/120

FOREIGN PATENT DOCUMENTS 0053340 6/1982 European Pat. Off. ..... 36/120
2107659 9/1972 Fed. Rep. of Germany ..... 36/117
2335679 4/1975 Fed. Rep. of Germany ... 24/69 SK
3247516 6/1984 Fed. Rep. of Germany ..... 36/117
3342121 6/1984 Fed. Rep. of Germany ..... 36/117
2448872 9/1980 France ..... 36/117
2450575 10/1980 France ..... 36/50
2475372 8/1981 France ..... 36/50

*Primary Examiner*—James Kee Chi
*Attorney, Agent, or Firm*—Sandler & Greenblum

[57] ABSTRACT

A manipulation element for closing and latching a rear spoiler of boot on the leg of a skier. The manipulation element is journaled on the rear spoiler so that journalling of this element tensions a cable which closes the spoiler on the leg of the skier. The manipulation element comprises a U-shaped lever having an open space therein adapted to receive a second manipulation element which can, for example, lock the heel of the foot in the boot. In this way, two manipulation elements can be positioned on the dorsal zone of the spoiler. In another embodiment, the manipulation element includes two lateral ribs, each having a groove extending along the length of the rib for engaging and protecting the cable.

27 Claims, 6 Drawing Sheets

FIG. 5.
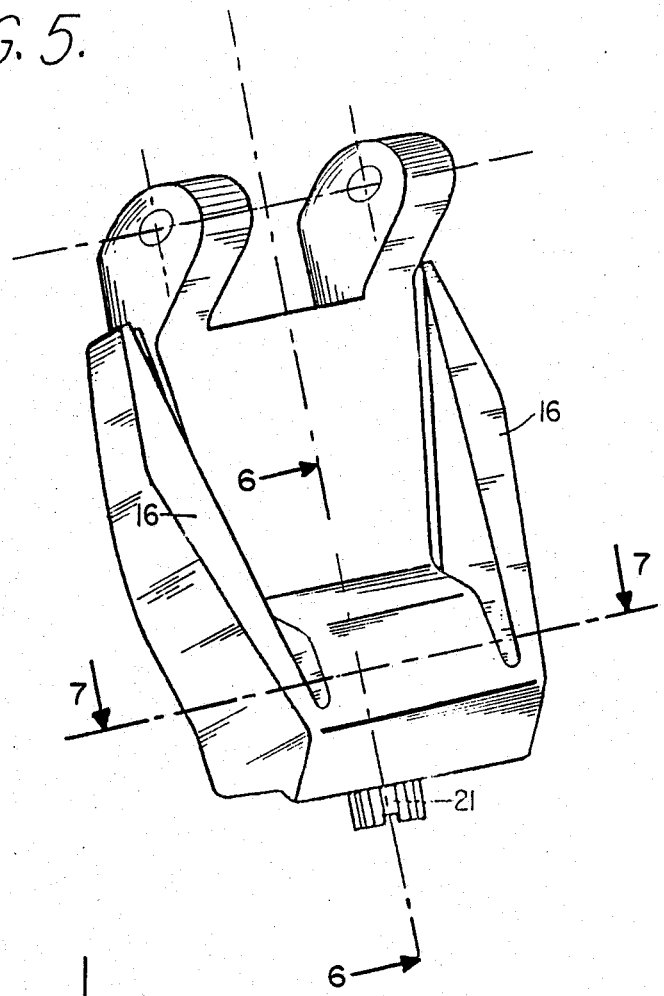
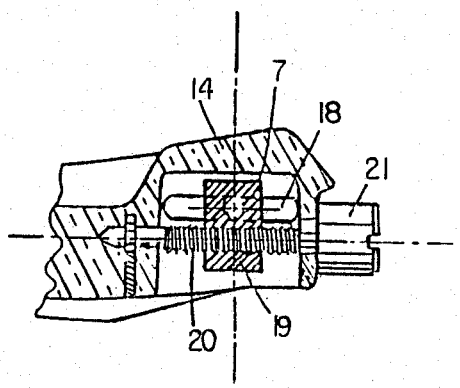
FIG. 6.
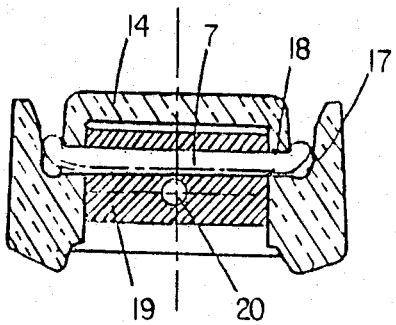
FIG. 7.

MANIPULATION LEVER FOR CLOSING AND LATCHING OF A REAR-ENTRY SKI BOOT

This is a division of application Ser. No. 700,302 filed Feb. 11, 1985, now U.S. Pat. No. 4,698,920.

BACKGROUND OF THE INVENTION

1. Field of the Invention

The present relates to rear-entry type ski boots and more particularly to a manipulation lever for closing and latching the upper of such a ski boot around the lower leg of the skier.

2. Background Information

Rear-entry type ski boots comprise a rigid shell base and an upper, at least the portion of which is journaled on the shell base. The upper, in turn, comprises a cuff and a rear spoiler. The rear spoiler is usually journaled on the shell base around a horizontal transverse axis. This horizontal transverse axis can be identical to the axis around which the cuff is also journaled or attached to the shell base. The rear spoiler is adapted to pivot around the horizontal transverse axis in the rearward direction to permit the foot of the skier to be introduced into the boot by a frontward movement.

In order for the insertion of the foot into the boot to be as efficient as possible in preparing to ski and in order to maximize the comfort of the skier it is necessary to insure that the upper is latched and closed on the lower leg of the skier by securing the rear spoiler to the cuff.

In conventional rear-entry ski boots this latching of the rear spoiler on the cuff is accomplished by means of three elements: a cable, means for adjusting the position of the anchoring of the cable to each side of the cuff, and means for tightening the cable. The cable is attached to each lateral side of the cuff by a hook and rack. The cable extends from this hook and rack to guides which are mounted on each lateral side of the rear spoiler. From the guides, the cable extends to the dorsal portion of the rear spoiler where it is attached to a manipulation lever journaled on the rear spoiler. The lever is adapted to be latched to a closed position in which the cable is tensioned which closes the spoiler on the cuff.

This lever in conventional systems has the general configuration of a solid plate, either cambered or not cambered, which extends over a substantial portion of the width of the dorsal portion of the rear spoiler.

In addition to tightening the spoiler on the lower leg of the skier, rear-entry ski boots must also perform other functions which necessitate supplemental elements that must be manipulated and adjusted. For example, in addition to the closure of the upper on lower leg of the skier, it is important that the heel be locked in the boot and it is important that the foot be held in the boot by an interior tightening apparatus adapted to be adjusted from the exterior of the boot by the user. It would be useful to be able to position these additional supplemental tightening elements on the dorsal portion of the rear spoiler for the following reason.

If this manipulation element for tightening the interior portion of the foot in the boot is placed on another portion of the boot such as the lateral portion of the boot, this manipulation element may be damaged by contact with foreign bodies encountered during skiing. Furthermore, placing the manipulation element on the side of the boot would increase the size and unweldingness of the boot. Placing the manipulation element on the dorsal portion of the spoiler would reduce the severity of, or eliminate these problems. Thus, the dorsal portion of the rear spoiler is the ideal location for such a manipulation element. However, the dorsal portion of the rear spoiler is already occupied by the manipulation lever previously described, thereby preventing the addition of any other manipulation elements on the dorsal portion of the rear spoiler.

Unless these two closure functions (closing the upper on the lower leg and tightening of the foot in the interior of the boot) are performed by single manipulation element such as is taught in French Patent Application 82 20 887, it is difficult to find an adequate location on the exterior of the boot for positioning the internal tightening manipulation element.

Thus, there is a need for a manipulation lever that closes the spoiler on the cuff which permits the positioning of an additional manipulation element on the dorsal portion of the rear spoiler.

In addition, rear-entry ski boots may position the cable so as to extend along the length of the lateral edges or exterior edges of the manipulation lever to the lower end of the manipulation lever. As a result, the cable can be exposed to shocks during skiing and can be damaged by various obstacles and objects which are encountered during skiing.

Furthermore, the manipulation lever and manipulation elements on the rear spoiler are often designed to be manipulated not only manually by the skier, but by the action of the other boot or the ski itself on the manipulation lever so that it is not necessary for the skier to bend down to manually adjust the manipulation elements. During this type of manipulation of the manipulation elements, the cable which is adjacent the manipulation elements, can be damaged very quickly by the boot or the ski.

Therefore, there is also a need to protect the cable from this type of damage.

SUMMARY OF THE INVENTION

It is therefore, an object of the present invention to provide an manipulation lever on the dorsal portion of the rear spoiler which permits the positioning of an additional manipulation element on the rear spoiler.

In addition, it is another object of the present invention to provide an manipulation lever on rear-entry ski boots which protect the tensioning cable used to close and latch the spoiler on the cuff.

These and other objects of the present invention are accomplished by a manipulation element for closing and latching a rear spoiler of a boot on the leg of the skier. In this embodiment of the manipulation element a cable is attached to the boot and the manipulation element. One end of the element is journaled on the rear spoiler, and journalling of the element on the spoiler tensions the cable. In turn, tensioning of the cable closes the spoiler on the leg. In order to accomplish these goals of permitting an additional manipulation element to be positioned on the dorsal portion of the spoiler, the manipulation element comprises a generally U-shaped member which forms an open space adapted to receive this additional manipulation element.

In one embodiment, the manipulation element comprises a manipulation lever journaled on the spoiler. In another embodiment, the invention comprises the above-recited manipulation element in combination with another manipulation element having a different function than the first manipulation element, such as the ability to tighten or lock the heel of the foot in the boot.

The shape of the open space can be complementary to the exterior contour of the other manipulation element such that the periphery of the open space is substantially the same shape as the periphery of the exterior contour of the other manipulation element. In one embodiment, the shape of the open space and the shape of another manipulation element can be substantially cylindrical or substantially conical.

In still another embodiment, the manipulation element comprises two lateral arms connected by a lower end portion positioned between the arms. The cable is connected to the manipulation element at this lower end portion.

The boot to which the manipulation element is adapted to be attached further comprises a rigid shell base and an upper. The upper comprises a rear spoiler and a cuff. The rear spoiler is at least partially journaled on the shell base around a transverse axis. Furthermore, the boot further comprises two anchors positioned on each lateral side of the cuff for anchoring the cable thereon. In addition, the boot also comprises two guides positioned on each lateral side of the spoiler for guiding the cable between the anchors and the manipulation element. The anchors can comprise a hook and rack-type anchor for adjusting the position of the cable on the cuff. Alternatively, the cuff can comprise means for guiding the cable over and in the cuff and for permitting the cable to surround the anterior portion of the leg. In either of these embodiments, the invention can comprise the manipulation element in combination with such a boot. In addition, the rear spoiler can comprise a dorsal portion, and the manipulation element can be journaled on this dorsal portion of the rear spoiler.

In still another embodiment, the invention comprises a rear entry ski boot for holding the foot and the leg of the skier. The boot comprises a rigid shell base, and upper, a manipulation lever, a cable, two anchors, and two guides. The upper comprises a cuff and a rear spoiler which is at least partially journaled on the shell base around a transverse axis.

The manipulation lever is journaled on the rear spoiler so that this lever comprises means for closing and latching the rear spoiler on the leg of the skier in response to journalling of the lever. In addition, the lever is generally U-shaped so as to form an open space therein which is adapted to receive another manipulation element having a function different from the manipulation lever. The invention can also comprise this boot in combination with the manipulation element. The manipulation element can comprise, for example, means for tightening the heel of the foot in the boot.

The shape of the open space can be complementary to the contour of the manipulation element so that the shape of the periphery of the open space is substantially the same as the shape of the contour of the manipulation element. The shape of the open space and the shape of the contour of the manipulation element can be substantially cylindrical, or substantially conical.

The cable is attached to the lower end portion of the lever. In addition, the cable is placed under tension in response to journalling of the lever so as to comprise means for closing and latching the spoiler on the leg.

The two anchors are positioned on each lateral side of the cuff for anchoring the cable thereon, and the two guides are positioned on each lateral side of the rear spoiler for guiding the cable between the anchor and the lower portion of the lever. In addition the spoiler can comprise a dorsal portion on which the lever is journaled and over which the lever extends.

In still another embodiment, the invention comprises a manipulation element for closing and latching a rear spoiler of a boot on the leg of a skier. In this embodiment, the boot further comprises a cable attached to the boot and the element. This manipulation element is journaled on the spoiler so that journalling of the element on the spoiler tensions the cable, and the tensioning of the cable closes and latches the rear spoiler on the leg. The manipulation element comprises a base and two lateral ribs on opposite sides of the base which are adapted to engage the cable so as to comprise means for protecting the cable.

In one embodiment, the ribs have a cross-sectional area larger than the cross-sectional area of the cable and the ribs are adapted to receive the cable therein. The manipulation element further comprises a lower end portion on the end of the element opposite from the end at which the element is journaled on the spoiler. The cable is adapted to engage this lower end portion of the element as the cable extends between the two ribs. In addition, the ribs can extend along the length of the dorsal portion of the rear spoiler.

Furthermore, each rib comprises a groove extending along at least a portion of the length of the rib and along the base. The groove is adapted to receive the cable therein and the groove extends out of a plane passing through the base. Each groove comprises an outer edge and each groove is sufficiently deep that when the cable is positioned in each groove the outer edge of the groove extends beyond the cable. In addition, each rib comprises an interior edge and each groove is positioned on this interior edge of the rib.

In addition, the manipulation element further comprises a journalled end journaled on the spoiler and a free end on the opposite end of the element from the journaled end. In one embodiment, the height of each rib increases from the free end to the journaled end. In an alternative embodiment the height of each rib increases from the journaled end to the free end of the element. In addition, each groove comprises at least one edge having a bevel to facilitate positioning of the cable in the groove.

In another embodiment, the free end of the element is in the form of a housing having a bottom portion which is open to the exterior. The housing comprises a slit extending laterally across the housing to connect the grooves with each other and also extending in the longitudinal direction of the element a distance greater than the diameter of the cable. In addition, the housing further comprises a nut and screw. The nut comprises an opening therein aligned with the slit so that the slit and the opening are adapted to receive the cable as the cable extends between the two grooves. Furthermore, the element further comprises means for preventing the nut from rotating in the housing and the nut is adapted to be displaced in the longitudinal direction in response the rotation of the screw. The screw further comprises a head positioned on the exterior of the housing so that the screw can be manipulated from the exterior of the manipulation element.

The manipulation element in one embodiment, can comprise a generally U-shaped lever having two lateral arms and an open space therebetween which is adapted to receive another manipulation element having a different function from this manipulation element. Alternatively, the base of the manipulation element can extend continuously between the two ribs. In this embodiment the base and the ribs form a generally U-shaped recess adapted to receive another manipulation element which is also journalled on the rear spoiler.

Furthermore, the boot can further comprise a rigid shell base and an upper, wherein the upper comprises a rear spoiler and a cuff. The spoiler is at least partially journaled on the shell base around a transverse axis. In addition, the boot further comprises two anchors positioned on each lateral side of the cuff for anchoring the cable thereon. Two guides are also provided on the boot and are positioned on each lateral side of the spoiler for guiding the cable between the anchors and the manipulation element. In one embodiment, the invention comprises the manipulation element recited above in combination with such a boot.

Finally, the invention also comprises a rear entry ski boot for holding the foot and the leg of the skier. The boot comprises a rigid shell base, and upper, cable, and a manipulation lever. The upper comprises a cuff and a rear spoiler at least partially journaled on the shell base around a transverse axis. The manipulation lever is journaled on the rear spoiler. The lever comprises means for tensioning the cable and the cable comprises means for closing and latching the rear spoiler on the leg of the skier in response to tensioning of the cable by journalling of the lever. In this embodiment, the lever comprises a base and two lateral ribs on each lateral side of the base and lever which are adapted to engage the cable so as to comprise means for protecting the cable. The lever also comprises a lower end portion which is adapted to engage the cable between the ribs. In addition, two anchors are also provided on each lateral side of the cuff for anchoring the cable thereon. Alternatively, the cuff can comprise means for guiding the cable over and in the cuff and for permitting the cable to surround the anterior portion of the leg.

The rib has a cross-sectional area greater than the cross-sectional area of the cable. Furthermore, each rib comprises an interior edge and a groove extending over at least a portion of the edge at the base. The groove is adapted to receive the cable and the groove extends out of a plane passing through the ribs.

The lever can comprise a journalled end journaled on the spoiler, and a free end on the opposite end of the lever from the journaled end. In this embodiment, the height of each rib increases from the free end to the journaled end. Alternatively, the height of each rib can increase from the journaled end to the free end. In addition, each groove can comprise a bevel to facilitate positioning of the cable in the groove.

In addition, the free end can be in the form of a housing having a bottom side which is open and which comprises a slit extending laterally across the housing to connect the grooves with each other and also extending in the longitudinal direction a distance greater than the diameter of the cable. The housing further comprises a nut and a screw. The nut comprises an opening therein aligned with the slit so that the slit and the opening are adapted to receive the cable as the cable extends between the two grooves. In addition, the element further comprises means for preventing the nut from rotating in the housing. Finally, the nut is adapted to be displaced in the longitudinal direction in response to rotation of the screw, and the screw comprises a head positioned on the exterior of the housing so that it can be easily manipulated by the user.

BRIEF DESCRIPTIONS OF THE DRAWINGS

The characteristics of the invention as well as certain advantages will be come apparent from the detailed description which follows with reference to the attached drawings in which:

FIG. 1 illustrates a three-quarter rear perspective view of a rear entry ski boot including the manipulation lever of the present invention;

FIG. 2 llustrates a three-quarter rear perspective view of a ski boot and manipulation lever of a second embodiment of the invention;

FIG. 3 illustrates a perspective view of a lever having a "U" configuration according to the present invention;

FIG. 3*a* illustrates a cross-sectional view of the manipulation lever taken along II—II of FIG. 3;

FIG. 4 illustrates a perspective view of an alternative embodiment of the manipulation lever;

FIG. 4*a* illustrates a cross-sectional view of the lever taken along the plane III—III of FIG. 4;

FIG. 5 illustrates still another embodiment of the lever;

FIG. 6 illustrates a cross-sectional view taken along plane IV—IV of FIG. 5; and FIG. 7 shows a cross-sectional view of the manipulation lever of FIG. 5 taken along line V—V of FIG. 5.

DETAILED DESCRIPTION OF PREFERRED EMBODIMENTS

Figure 1:
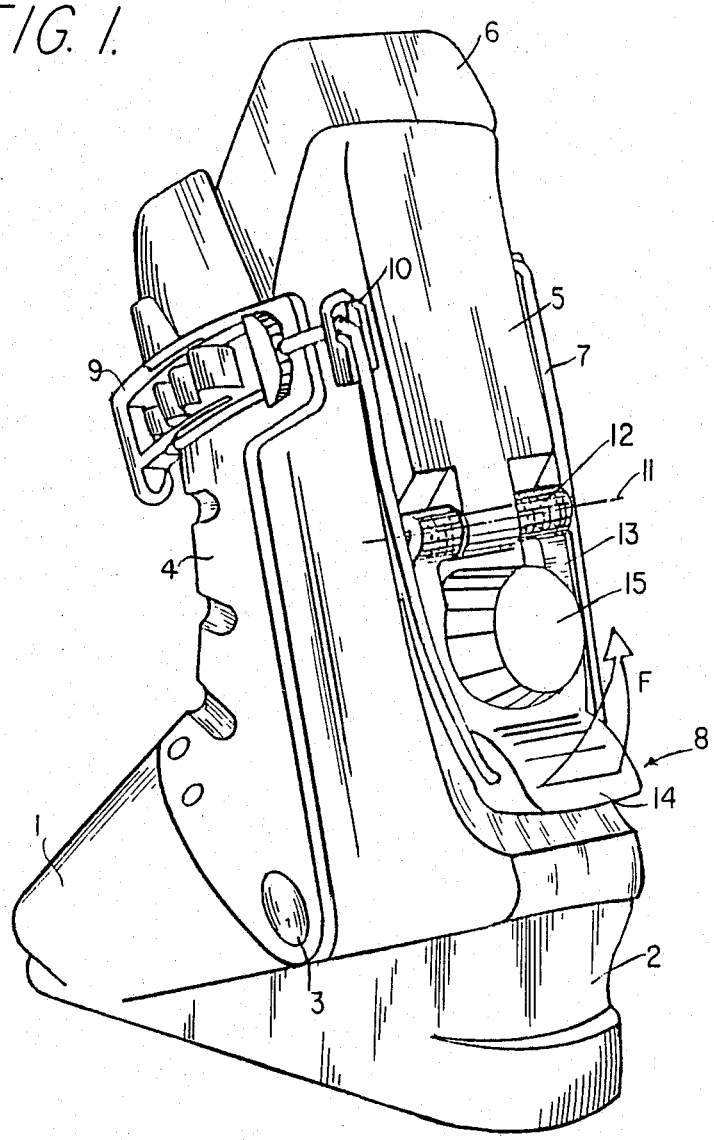
Figure 2:
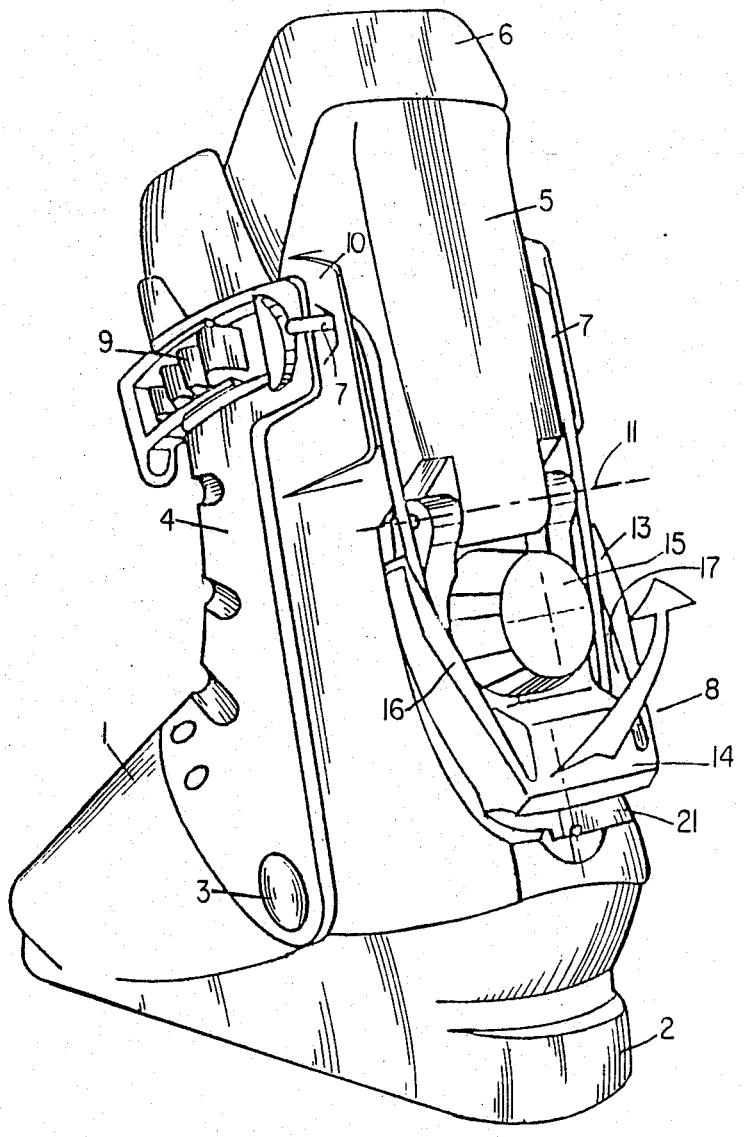

FIGS. 1 and 2 illustrate rear entry-type ski boots. They comprise a rigid shell base 1 formed integrally with a sole 2. The boot also comprises an upper comprising a cuff 4 and a rear spoiler 5. The upper is journaled around substantially horizontal axis 3 of shell base 2. In addition, the boot further comprises an interior slipper 6 which is composed of a soft material.

The closing of the upper on the lower leg of the skier is accomplished by the cooperation of a cable 7 and a manipulation lever 8. Cable 7 is laterally anchored on both sides of cuff 4, for example, by at least one adjustment apparatus 9 of the hook and rack type which is well known in the art. Apparatus 9 can adjust the position of cable 7 on cuff 4.

Alternatively, cuff 4 can comprise means for guiding cable 7 in or on cuff 4 by permitting cable 7 to surround the anterior portion of the lower leg of the wearer. Cable 7 extends from apparatus 9 through lateral guides 10 which are positioned on each lateral side of rear spoiler 5. Cable 7 then descends on both lateral sides of the dorsal zone of the rear spoiler to lower end 14 of manipulation lever 8 where it is attached to end 14 of manipulation lever 8.

Manipulation lever 8 comprises an upper end which is journaled around a transverse axis pin 11 attached to rear spoiler 5, and therefore lever 8 is journaled on rear spoiler 5. In addition, a spring 12 is provided around axis pin 11. As a result, lever 8 is adapted to be pivoted in the direction of arrow F against the bias of spring 12 to an open position to relieve the tension in cable 7, and manipulation lever 8 is also adapted to be pivoted into the closed position seen in FIG. 1 and 2 in which lever 8 tensions cable 7 to close spoiler 5 on cuff 4. This operation of lever 8 is known in the art and therefore does not require further discussion.

In accordance with the present invention, the manipulation lever does not extend continuously between its two lateral sides so as to cover (in its closed position seen in FIG. 1) the entire dorsal zone on a rear spoiler 5. Rather, lever 8, according to the present invention, is generally shaped in the form of a "U" or horseshoe comprising two arms 13 connected by a lower base portion 14. Lever 8 is journaled on axis pin 11 at one end of arms 13. In addition, lever 8 is connected to cable 7 at base 14. Base 14 preferably projects away from spoiler 5 to facilitate manipulation of the lever.

By virtue of this arrangement, the dorsal portion of rear spoiler 5 positioned between arms 13 of lever 8 (in a closed position seen in FIG. 1) is not occupied by lever 8 and can thus be occupied by another manipulation element 15. Manipulation element 15 can serve a variety of functions, such as locking the heel in the boot or securing the foot in the boot. Such adjustment elements are known in the art.

Thus, the two essential closure functions, i.e., latching of the upper on the lower leg of the skier and the internal locking of the heel in the shell base, can be performed in an extremely practical fashion by the generally "U" shape lever and a separate manipulation element situated in the same dorsal zone as of the rear spoiler as lever 8 without the necessity of adding any additional element which would project dangerously from the boot at another point thereon. In a preferred embodiment, the exterior configuration or contour of manipulation element 15 is complementaty to the interior configuration of the open space between arms 13. In other words, the exterior contour of manipulation element 15 will be substantially identical in shape to the periphery of the open space between arms 13. In addition, it is within the scope of the invention for both of these contours to be substantially cylindrical or substantially conical.

In the embodiment seen in FIG. 1, cable 7 extends along the length of the lateral edges of arms 13 of lever 8. Cable 7 can be exposed to shocks and can encounter various obstacles and diverse objects during skiing. Furthermore, cable 7 is susceptible to damage by the other boot and by the ski itself when the skier uses the other boot or the ski itself to open or close lever 8 or manipulation element 15.

In order to protect cable 7 the embodiments illustrated in FIGS. 2–7 have been developed.

Figure 3:
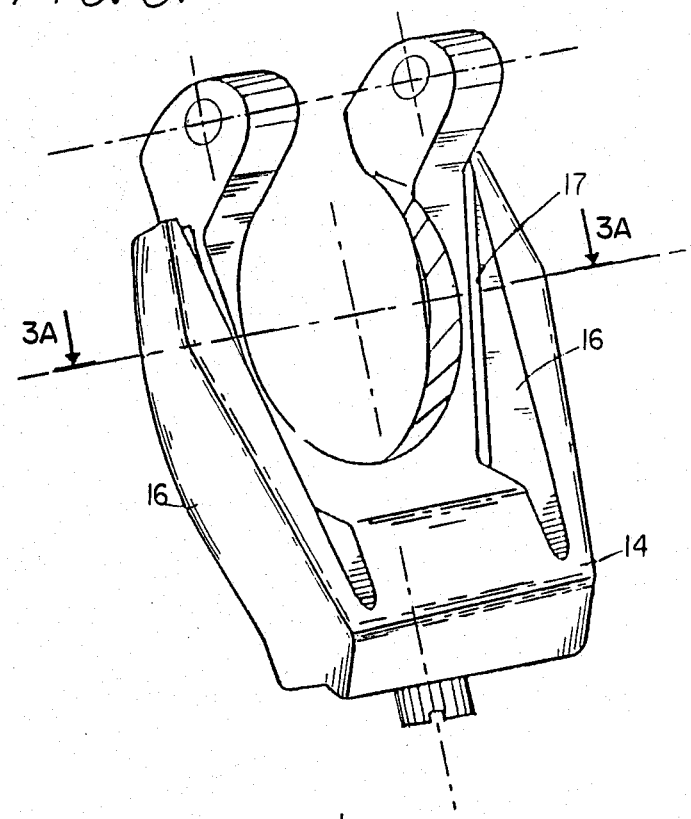
Figure 4:
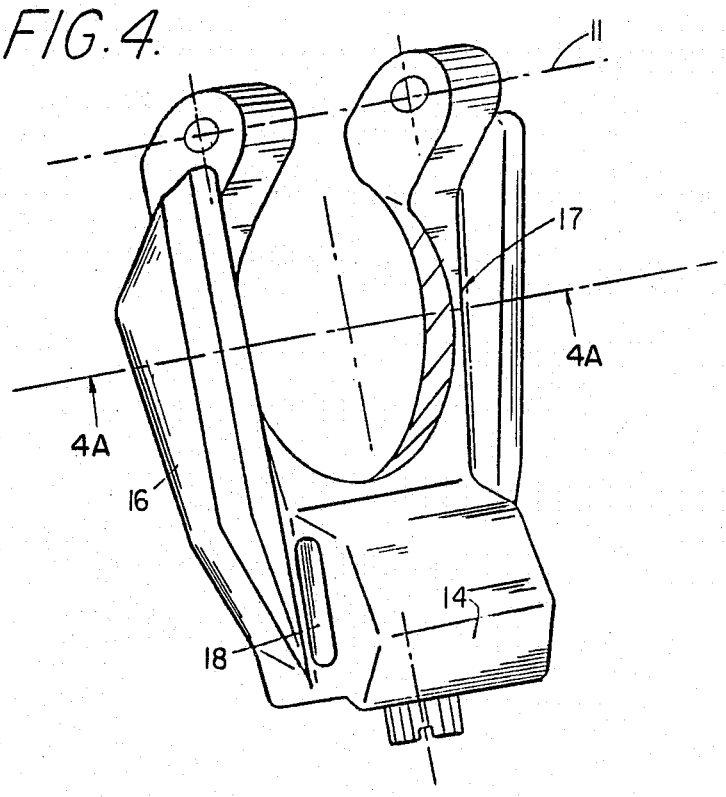
Figure 8:
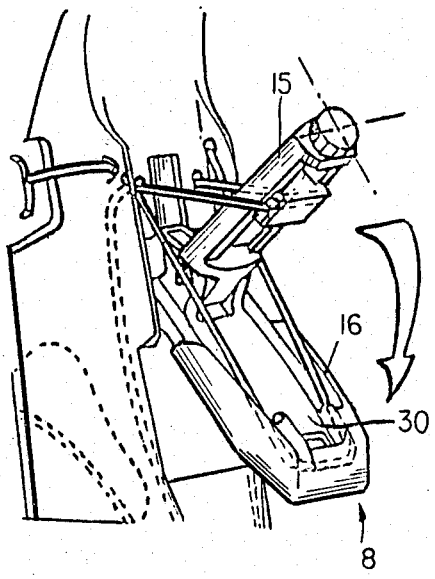
FIG. 8 illustrates a perspective view of two manipulation elements according to the present invention.

The cable protection means can be used in manipulation levers having a general U-shape, as seen in FIGS. 3 and 4, or in levers having a solid construction in which a base of the lever extends continuously between the lateral sides of the lever, as seen in FIGS. 5 and 8.

As seen in FIGS. 5 and 8, lever 8 comprises a base 30 and two ribs 16 positioned on opposite lateral sides of base 30. A groove 17 is formed along at least a portion of the length of each rib 16 at the intersection of base 30 and rib 16 along the interior edge of rib 16. Base 30 and ribs 16 together form a generally U-shaped recess adapted to receive manipulation element 15 which can also be journalled on the dorsal portion of spoiler 5.

As illustrated in FIG. 2–7, lever 8 comprises two lateral ribs 16 having a cross-sectional area which is greater than the of cross-sectional area of cable 7, and in which cable 7 is protected. Ribs 16 comprise a groove 17 extending along at least a portion of the length of rib 16 and positioned at base 30 of rib 16. Grooves 17 extend through and out of a plane passing through the base of element 8.

Grooves 17 are positioned on the interior edge of arms 16 and are of sufficiently greater cross-sectional area than cable 7 so that cable 7 can be lodged therein and so that cable 7 does not protrude from ribs 16. As a result, cable 7 is protected by rib 16 and groove 17. In other words, the outer edge of groove 17 extends beyond cable 7 when cable 7 is received in groove 17.

Figure 3A:
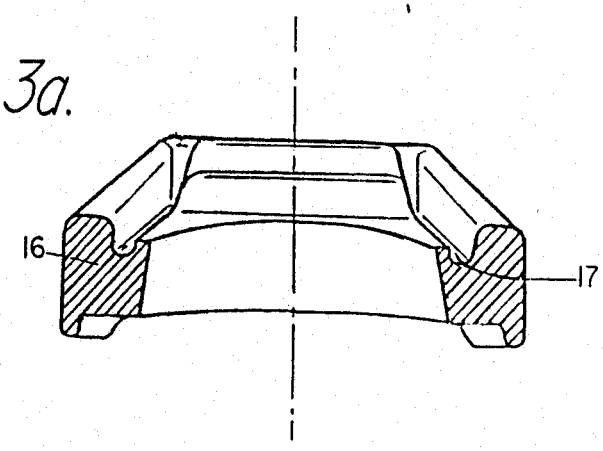
Figure 4A:
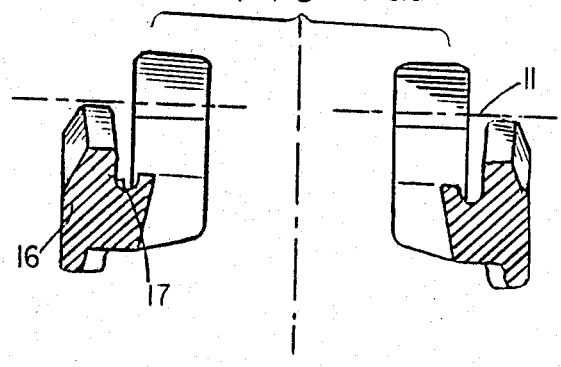

As seen in FIGS. 3 and 3*a* ribs 16 increase in height from the journaled end of lever 8 (the end of lever 8 attached to journal axis pin 11) to free end 14 of lever 8. An alternative embodiment is shown in FIGS. 4 and 4*a* in which the height ribs 16 increases from free end 14 to the journaled end of lever 8.

In addition, to facilitate placement of cable 7 and groove 17, the inner edges of grooves 16 comprise bevels as shown in FIG. 7.

Cable 7 can be connected to lower end 14 of lever 8 in a variety of ways. In one embodiment seen in FIG. 4 lower end 14 of lever 8 comprises a transverse slit 18 through which cable 7 extends between grooves 17 in each lateral rib 16. Alternatively, cable 7 can extend along the outer wall of free end 14.

Preferably however, end 14 of lever 8 is in the form of a housing which is open to the exterior at the bottom as seen in FIGS. 6 and 7. The housing comprises a longitudinal slit 18 which extends in the lateral direction between each groove 17 as seen in FIG. 7, and also extends in the longitudinal direction as seen in FIG. 6.

The length of slit 18 along the longitudinal direction is substantially greater than the diameter of cable 7 so as to permit cable 7 to be displaced in the longitudinal direction in slit 18 as will be discussed below.

Lever 8 also comprises a nut 19 and a longitudinal screw 20 both of which are also positioned in the housing. Nut 19 is positioned in a transverse direction in the housing and comprises an opening along the longitudinal axis of nut 19 which is aligned with slit 18 and grooves 17 so as to permit passage of cable 7 through slit 18 between grooves 17. The lateral walls of the housing prevent rotation of nut 19. However, nut 19 can be displaced in the longitudinal direction in response to the rotation of the longitudinal screw 20 which passes through nut 19. As can be noted from FIGS. 6 and 7 screw 20 is prevented from moving in any direction except about its longitudinal axis by the housing. As can also be seen from FIGS. 6 and 7 screw 20 comprises a head 21 which is accessible from the exterior so screw 20 can be easily rotated by the skier. The rotation of screw 20 permits the adjustment of the position of cable 7 with respect to the housing in the longitudinal direction.

From the description that has preceeded, it will be evident that the invention protects the cable from any obstacles or kicks experienced during skiing and also allows for manipulation of the lever with the boot without damaging the cable in boots having semi-automatic closure by means of a rear lever.

Although the invention has been described with respect to the preferred embodiments discussed above, it is clearly understood that this is by way of example only, and that the invention is not limited to the particulars disclosed but extends to all equivalents within the scope of the claims.

What is claimed is:

1. A manipulation element for closing and latching a rear spoiler of a boot on a leg of a skier, wherein said boot further comprises a cable attached to said boot and said element, wherein said element is journalled on said rear spoiler, wherein journalling of said element on said rear spoiler tensions said cable, wherein tensioning of said cable closes and latches said rear spoiler on said leg, wherein said element comprises two lateral ribs adapted to engage said cable so as to comprise means for protecting said cable, wherein said element further comprises a lower end portion on an end of said element opposite from the end at which said element is journalled on said rear spoiler, wherein said cable is adapted to engage said lower end portion of said element as said cable extends between said two ribs.

2. The manipulation element defined by claim 1 wherein said ribs have a cross-sectional area larger than the cross-sectional area of said cable, wherein said ribs are adapted to receive said cable therein.

3. The manipulation element defined by claim 1 wherein said rear spoiler comprises a dorsal portion, wherein said ribs extend along the length of said dorsal portion of said rear spoiler.

4. The manipulation element defined by claim 1 wherein said element further comprises a base, wherein said ribs are attached to opposite sides of said base, wherein each rib comprises a groove, extending along at least a portion of the length of said rib along said base, wherein said groove is adapted to receive said cable therein and said groove extends out of a plane passing through said base.

5. The manipulation element defined by claim 4 wherein each groove comprises an outer edge, wherein each groove is sufficiently deep that when said cable is positioned in each groove said outer edge of said groove extends beyond said cable.

6. The manipulation element defined by claim 5 wherein each rib comprises an interior edge, wherein each groove is positioned on said interior edge of said rib.

7. The manipulation element defined by claim 4 further comprising a journalled end journalled on said spoiler and a free end on the opposite end of said element from said journalled end, wherein the height of each rib increases from said free end to said journalled end of said element.

8. The manipulation element defined by claim 4 further comprising a journalled end journalled on said spoiler and a free end on the opposite end of said element from said journalled end, wherein the height of each rib increases from said journalled end to said free end of said element.

9. The manipulation element defined by claim 1 wherein each groove comprises at least one edge, wherein said at least one edge of each groove comprises a bevel to facilitate the positioning of said cable in said groove.

10. The manipulation element defined by claim 1 wherein said element further comprises a journalled end journalled on said rear spoiler and a free end on the opposite end of said element from said journalled end, wherein said free end is in the form of a housing having a bottom portion wherein said bottom portion is open to the exterior and wherein said housing further comprises a slit extending laterally across said housing to connect said grooves with each other, wherein said slit also extends in the longitudinal direction a distance greater than the diameter of said cable, wherein said housing further comprises a nut and a screw, wherein said nut comprises an opening therein aligned with said slit wherein said slit and said opening are adapted to receive said cable as said cable extends between said two grooves, wherein said element further comprises means for preventing said nut from rotating in said housing, and wherein said nut is adapted to be displaced in the longitudinal direction in response to rotation of said screw, wherein said screw further comprises a head positioned on the exterior of said housing.

11. The manipulation element defined by claim 1 wherein said element comprises a generally U-shaped lever having two lateral arms and an open space between said two lateral arms, wherein said open space is adapted to receive another manipulation element having a different function from said manipulation element.

12. The manipulation element defined by claim 1 wherein said element comprises a base which extends continuously between said two ribs.

13. The manipulation element defined by claim 12 in combination with another manipulation element journalled on said rear spoiler, wherein said another journal element is positioned above said base, wherein said base and said ribs of said manipulation element form a generally U-shaped recess adapted to receive said another manipulation element therein.

14. The manipulation element defined by claim 1 wherein said boot further comprises a rigid shell base and an upper, wherein said upper comprises a rear spoiler and a cuff, wherein said rear spoiler is at least partially journalled on said shell base around a transverse axis, wherein said boot further comprises two anchors positioned on each lateral side of said cuff for anchoring said cable thereon, wherein said boot further comprises two guides positioned on each lateral side of said spoiler for guiding said cable between said anchors and said manipulation element.

15. The manipulation element defined by claim 14 in combination with said boot.

16. A rear entry ski boot for holding the foot and the leg of a skier, wherein said boot comprises:

(a) a rigid shell base;

(b) an upper, wherein said upper comprises:

(i) a cuff; and (ii) rear spoiler at least partially journalled on said shell base around a transverse axis;

(c) a cable; and (d) a manipulation lever journalled on said rear spoiler wherein said manipulated lever comprises means for tensioning said cable, wherein said cable comprises means for closing and latching said rear spoiler on the leg of said skier cable by journalling of said manipulation lever, wherein said in response to tensioning of said manipulation lever comprises two lateral ribs on each lateral side of said manipulation lever, wherein said ribs are adapted to engage said cable so as to comprise means for protecting said cable, and wherein said manipulation lever further comprises a lower end portion, wherein said lower end portion is adapted to engage said cable between said ribs.

17. The boot defined by claim 16 further comprising:

(e) two anchors positioned on each lateral side of said cuff for anchoring said cable thereon.

18. The boot defined by claim 16 wherein said leg comprises an anterior portion, wherein said cuff further comprises means for guiding said cable over or in said cuff and for permitting said cable to surround said anterior portion of said leg.

19. The boot defined by claim 16 wherein rib has a cross-sectional area greater than the cross-sectional area of said cable.

20. The boot defined by claim 16 wherein said lever further comprises a base, wherein said ribs are attached to each lateral side of said base, wherein each rib comprises a groove extending over at least a portion of said edge at said base, wherein said groove is adapted to receive said cable and said groove extends out of a plane passing through said base.

21. The boot defined by claim 16 wherein said lever comprises a journalled end journalled on said rear spoiler and a free end on the opposite end of said lever from said journalled end, wherein the height of each rib increases from said free end to said journalled end.

22. The boot defined by claim 16 wherein said lever comprises a journalled end journalled on said rear spoiler and a free end on the opposite end of said lever from said journalled end, wherein the height of each rib increases from said journalled end to said free end.

23. The boot defined by claim 16 wherein each groove comprises a bevel to facilitate positioning of said cable in said groove.

24. The boot defined by claim 16 wherein said lever further comprises a journalled end journalled on said rear spoiler and a free end on the opposite end of said lever from said journalled end, wherein said free end is in the form of a housing having a bottom side wherein said bottom side is open and wherein said housing further comprises a slit extending laterally across said housing to connect said grooves with each other, wherein said slit also extends substantially in the longitudinal direction a distance greater than the diameter of said cable, wherein said housing further comprises a nut and a screw, wherein said nut comprises an opening therein aligned with said slit wherein said slit and said opening are adapted to receive said cable as said cable extends between said two grooves, wherein said element further comprises means for preventing said nut from rotating in said housing, and wherein said nut is adapted to be displaced in the longitudinal direction in response to rotation of said screw, wherein said screw further comprises a head positioned on the the exterior of said housing.

25. A manipulation element for closing and latching a rear spoiler of a boot on a leg of a skier, wherein said boot further comprises a cable attached to said boot and said manipulation element, wherein said manipulation element is journalled on said rear spoiler, wherein journalling of said manipulation element on said rear spoiler tensions said cable, wherein tensioning of said cable closes and latches said rear spoiler in said leg, wherein said manipulation element comprises two lateral ribs adapted to engage said cable so as to comprise means for protecting said cable, wherein said element comprises a generally U-shaped lever having two lateral arms and an open space between said two lateral arms, and wherein said open space is adapted to receive another manipulation element having a different function from said manipulation element.

26. A manipulation element for closing and latching a rear spoiler of a boot on a leg of a skier, wherein said boot further comprises a cable attached to said boot and said manipulation element, wherein said manipulation element is journalled on said rear spoiler, wherein journalling of said manipulation element on said rear spoiler tensions said cable, wherein tensioning of said cable closes and latches said rear spoiler on said leg, wherein said element comprises two lateral ribs adapted to engage said cable so as to comprise means for protecting said cable, wherein said element comprises a base which extends continuously between said two ribs, and wherein said base and said ribs of said manipulation element form a generally U-shaped recess adapted to receive another manipulation element therein.

27. The manipulation element defined by claim 2 in combination with another manipulation element journalled on said rear spoiler, wherein said another manipulation element is positioned above said base.

* * * * *

UNITED STATES PATENT AND TRADEMARK OFFICE

CERTIFICATE OF CORRECTION

PATENT NO. : 4,790,081

DATED : December 13, 1988

INVENTOR(S) : L. BENOIT et al.

It is certified that error appears in the above-identified patent and that said Letters Patent is hereby corrected as shown below:

At column 2, line 43, change "an" to ---a---, after "provide".

At column 2, line 47, change "an" to ---a--- after "provide".

At column 6, line 4, change "be come" to ---become---.

At column 6, line 10, change "llustrates" to ---illustrates---.

At column 6, line 37, change "2" to ---1---.

At column 6, line 63, change "FIG." to ---FIGS.---.

At column 10, line 43 (i.e., claim 16, line 10), change "manipulated" to --- manipulation---.

At column 10, line 46 (i.e., claim 16, line 13), after "skier" insert ---in response to tensioning of said---.

At column 10, lines 47 and 48 (i.e., claim 16, lines 14 and 15), delete "in response to tensioning of said".

At column 12, line 34, change "claim 2" to ---claim 26---.

Signed and Sealed this

Fifth Day of November, 1991

*Attest:*

*Attesting Officer*

HARRY F. MANBECK, JR.

*Commissioner of Patents and Trademarks*